US005852863A

United States Patent [19]

Müller et al.

[11] Patent Number: 5,852,863

[45] Date of Patent: Dec. 29, 1998

[54] METHOD OF PRODUCING A TRANSVERSE FORCE BOLT AND TRANSVERSE FORCE BOLT PRODUCED BY THIS METHOD

[75] Inventors: Erich Müller, Aarburg, Switzerland; Gottfried Breuer, Laufenburg, Germany

[73] Assignee: Pecon AG, Switzerland

[21] Appl. No.: 826,140

[22] Filed: Mar. 27, 1997

[51] Int. Cl.[6] ..... B23P 17/00

[52] U.S. Cl. ..... 29/417

[58] Field of Search ..... 29/417, 525.11, 29/525.14, 412; 411/513, 530, 900, 901, 902

[56] References Cited

FOREIGN PATENT DOCUMENTS 3801121 9/1988 Germany .

*Primary Examiner*—Paul T. Sewell

*Assistant Examiner*—Jermie E. Cozart

*Attorney, Agent, or Firm*—Speckman Pauley Petersen & Fejer

[57] ABSTRACT

A method for producing a transverse force bolt having a sheath made of a rod-shaped pipe of stainless steel which is drawn onto a rod-shaped core of conventional structural steel. In the process the exterior dimension is simultaneously calibrated. The rod-shaped semi-finished product is subsequently cut into rods, such as with a saw. With a hydraulic press the core is pushed out of the rod by a length and the ejected portion is cut off. Subsequently the core is pushed back by one-half the length of the cut-off portion and the open ends of the sheath are closed. The method produces a transverse force bolt of particularly great strength, which is very precise and has an extremely low cost.

5 Claims, 2 Drawing Sheets

METHOD OF PRODUCING A TRANSVERSE FORCE BOLT AND TRANSVERSE FORCE BOLT PRODUCED BY THIS METHOD

BACKGROUND OF THE INVENTION

1. Field of the Invention

This invention relates to a method of producing a transverse force bolt having a steel core and a sheath of stainless steel, and to a transverse force bolt produced in accordance with the method.

2. Description of Prior Art

Transverse force bolts are used for horizontal connection and force transfer between two structural components. They are particularly employed in the area of expansion gaps between two floor slabs, and used for placing slabs with connected structural elements on staircase landings. The transverse force bolts are seated on both sides of the expansion gaps in appropriate bearing sleeves. While a horizontal expansion movement must be permitted, it is intended to prevent relative vertical movement.

Transverse force bolts are inevitably subjected to environmental actions and therefore they can become corroded. Accordingly, many manufacturers have switched to producing transverse force bolts from high-grade stainless steel. Such transverse force bolts are preferably made of chrome-nickel-molibdenum steel. This is extremely expensive and yet might not meet safety requirements in certain areas of application. Rods made completely of stainless steel tend to become hydrogen-embrittled, which reduces the strength of the material.

Based on the above considerations, a change was made by designing tension or compression rods of corroding steel for connecting two concrete elements so that the rod is enclosed by a sleeve of corrosion-resistant material at least in the gap area, and so that a hardening material is poured into the gap between the sleeve and the steel. While this solution in accordance with German Patent Reference DE-A-38 01 121 has proven itself in connection with anchor bolts, for a number of reasons this system is not acceptable for use with transverse force bolts.

Many problems occur in connection with the exact embedding of the core in the sleeve and also during production of such transverse force bolts. For this reason this invention uses sleeves of stainless steel as a covering, into which shorter corroding steel rods are inserted as the core, and closes the open ends with a plastic plug. This solution results in transverse force rods which have excellently proven themselves with respect to the material properties.

As previously mentioned, the connection between two horizontal structural components assisted by transverse force rods is intended to practically stop movements in the vertical direction with respect to each other. However, the transverse force bolts of the last-named type, which are optimal with respect to material composition, are not able to meet these requirements sufficiently. Insertion of a steel core into a sheath of stainless steel requires some play. It is not possible for economical reasons to produce all components of a transverse force connection from calibrated elements. An insertion completely free of play, of a core into a sheath, is theoretically impossible, for technical reasons. Thus, with the known solution several tolerance areas result for reasons of production technology, which in the worst case can add up. For one, the exterior dimensions of the core and the interior dimensions of the sheath form one tolerance field. For another, the exterior dimension of the sheath has a tolerance field and the interior dimension of the bearing sleeve, in which the transverse force bolt is seated, also has such a tolerance field. As already mentioned, all these tolerances can add up. The play obtained in this way therefore results in some degree of freedom of movement in the vertical direction between two horizontal structural components which are connected with each other by means of transverse force bolt connections. The vibrations occurring in the building element therefore lead to vertical movements, which result in a corresponding crack formation in an area of the transverse force rod connections.

SUMMARY OF THE INVENTION

It is therefore one object of this invention to create a method for producing a transverse force bolt, having a steel core and a sheath of stainless steel, wherein the transverse force bolts produced in this manner no longer have the above mentioned disadvantages, to a large extent.

This object is attained by a method for producing a transverse force bolt having a steel core and a sheath, as discussed below.

If in the course of inserting the steel core into the sheath a calibration of the exterior dimensions of the sheath is performed, the tolerance field between the transverse force bolt and the bearing sleeve, in which the transverse force bolt is seated, is also reduced.

Depending on the area of application and the corresponding requirements it is possible for the transverse force bolt produced by the above-mentioned method to be either closed with a plastic plug, or it is possible to insert disks made of stainless steel into the open ends of the sheath and to weld the disks.

BRIEF DESCRIPTION OF DRAWINGS

The method in accordance with this invention is represented in the attached drawings, as well as two preferred embodiments of the transverse force bolt produced in accordance with this production process.

DESCRIPTION OF PREFERRED EMBODIMENTS

The initial materials for producing a transverse force bolt in accordance with the method of this invention include a core 1 comprising sheet steel and a sheath 2 comprising a tube of stainless steel. In this case the core 1 can be made of conventional structural steel. While the steps illustrated in FIGS. 1*a*–1*c* and described below usually are performed in appropriately equipped steel mills, the subsequent steps shown in FIGS. 1*d*–1*h* can be performed by any company making technical building products. The semi-finished product, is manufactured by steps shown in FIGS. 1*a*–1*c*, while the subsequent steps shown in FIGS. 1*d*–1*h* relate to finishing in accordance with specific orders.

Figure 1A:
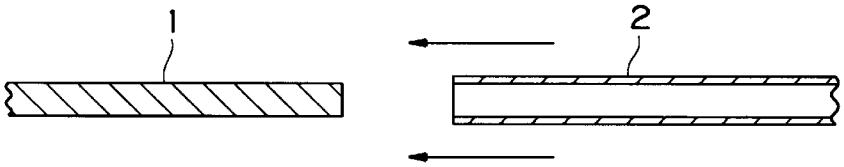
FIGS. 1*a*–1*h* are diagrammatic views showing different production steps according to one preferred embodiment of the method of this invention.
Figure 1B:
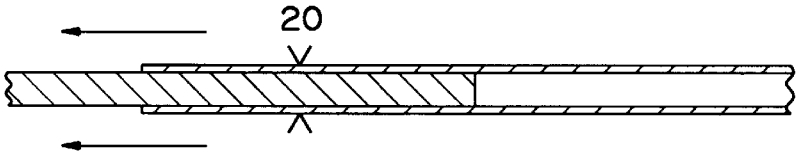

In a first step as shown in FIG. 1*a*, the sheath 2 of stainless steel is drawn in accordance with known technology over a correspondingly dimensional steel core 1 or rod, so that the steel rod then constitutes the core 1. During the draw-in process, the core 1 itself acts as a calibrating mandrel, and the desired approximate freedom from play is assured.

Figure 1C:
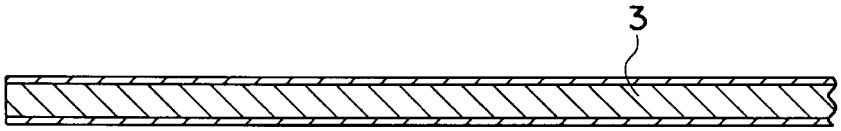

Depending on the production facility it is possible to calibrate the size of the sheath of stainless steel simultaneously or directly afterward. An appropriate calibrating tool is shown schematically by element reference numeral 20 in the step shown in FIG. 1*b*. The drawing of the core 1 into the sheath 2 takes place with conventional rod material of several meters length. The drawing-in step, which is extremely accurate to measurement and at least approximately free of play, of the steel core 1 takes place with the assistance of an oil which is particularly suitable for this purpose. The semi-finished product, represented in FIG. 1*c*, is shipped to the factory for producing technical building products.

Figure 1D:
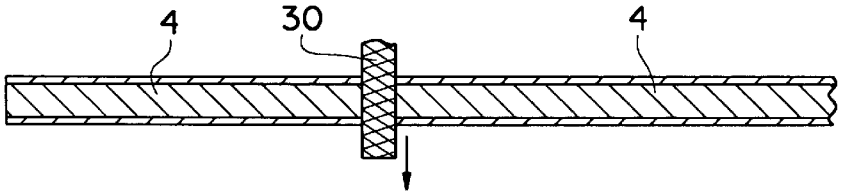
Figure 1E:
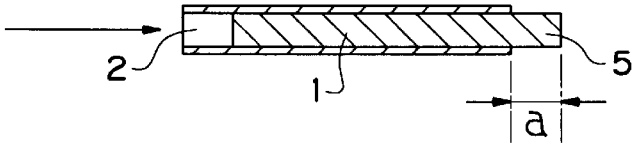
Figure 1F:
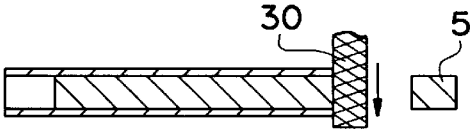

The firm receiving the semi-finished product cuts the rod material 3 to size into appropriate rod sections 4, as shown by the step in FIG. 1*d*. This is symbolically indicated by the saw blade 30. As schematically shown in FIG. 1*e*, the core 1 is pressed out of the sheath 2 by a length a. A protruding section or ejected part 5 is then cut off flush with the sheath end, as shown in FIG. 1*f*. Because of the oil used during the draw-in procedure, it is possible to press the core 1 out of the sheath 2 by means of appropriate hydraulic machines, without permanent deformations being noted.

However, some steel mills operate without oil during drawing-in step. In this case the cut-to-size rod sections 4 are briefly heated on the outside prior to pressing them out, wherein the sheath 2 is heated more than the core 1. This results in minimal expansion differences, which makes the pressing of the core 1 out of the sheath 2 easier.

Figure 1G:
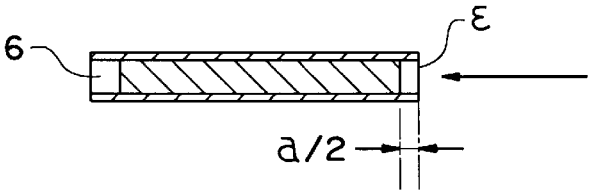
Figure 1H:
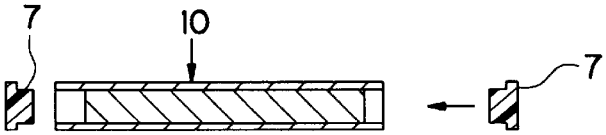

After cutting off of the ejected part 5 of the core 1, the steel core 1 is pressed back from the direction of the severed core into the sheath 2 by means of the same hydraulic tool, this time by one-half the length a of the severed ejected part 5, for example by a length equal to a/2. This situation is shown in FIG. 1*g*. A rod with the steel core 1 and the sheath 2 is produced in this way, wherein the open sheath ends 6 project past the steel core 1 on both sides. In the last production step in accordance with FIG. 1*h*, the open sheath ends 6 are now closed. In the end, the finished transverse force rod 10 is obtained in this way.

Figure 2:
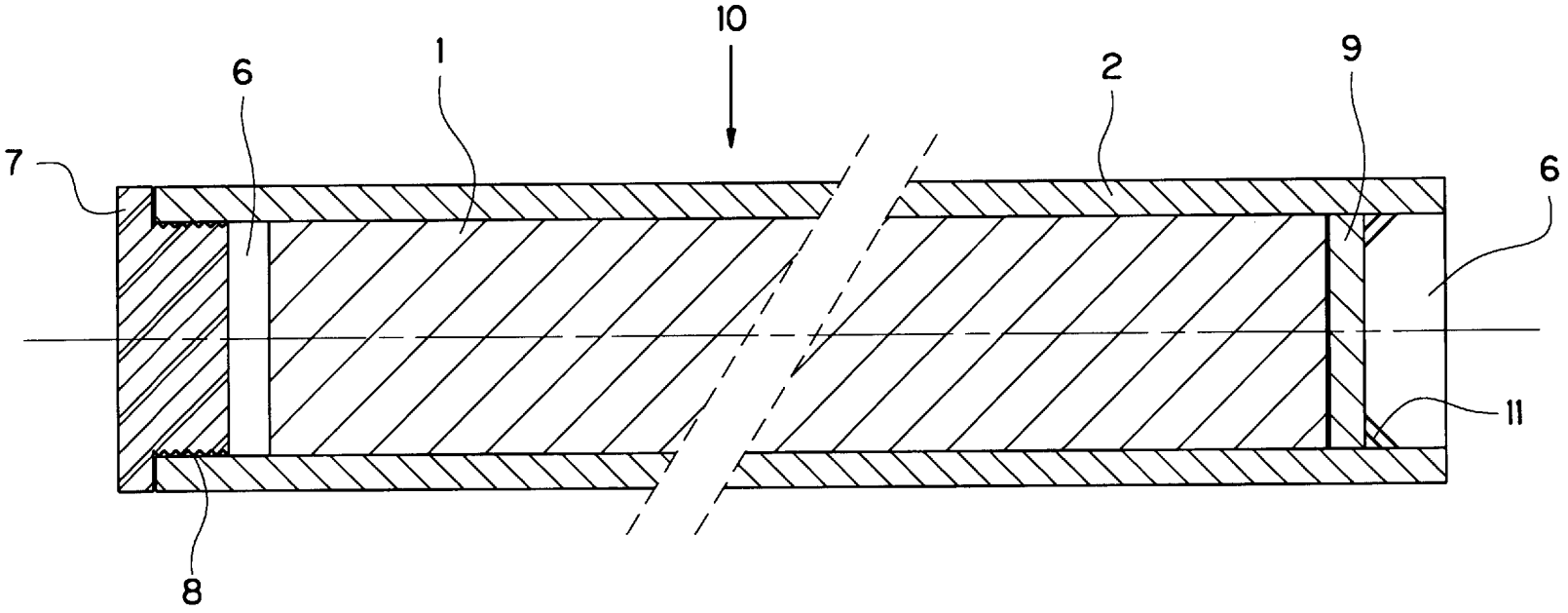
FIG. 2 is a cross-sectional view of a transverse force bolt produced in accordance with the method of this invention, with two different embodiments of the end closure.

A transverse force rod 10 produced in accordance with this invention is represented in FIG. 2. While one end of the transverse force rod 10 is closed by means of a plastic plug 7, the other end is closed with a disk 9 of stainless steel inserted into the open sheath end 6. Plastic plugs 7 are very suitable for some applications, in particular in the interiors of buildings. The required seal is achieved by appropriate seal lips 8 on the plastic plug 7. For applications with particularly large bearing strength, a disk 9 of stainless steel of as exact as possible measurements is inserted into the open sheath end 6 and welded with the sheath 2. Depending on the desired seal, the weld can either be made at points, or as a circumferential weld bead 11. The slightly increased strength in this case is not so much the result of a bearing effect of the disk 9, but is achieved by the absolute fixation of the core 1 in the sheath 2. This results in a very strong composite or sandwich structure.

As shown by the results of measurements during first tests, the strength of such a composite or sandwich structure is greater than that of a one-piece transverse force bolt made of a solid rod. It is accordingly possible with respect to the dimensions to employ transverse force bolts with a smaller diameter. This is not only a financial advantage, but also leads to a size reduction of the bearing sleeve of the transverse force bolt and therefore to an increased concrete covering of the bearing sleeve, which also has static structural advantages.

The wall thickness of the sheath 2 is basically selected as a defined relation with the diameter of the steel core 1. In the process it is possible to select unexpected light wall thicknesses for the sheath 2. Conventional sizes of the wall thickness of the stainless steel tube from which the sheath 2 is made lie between 0.4 mm and 5.0 mm. The relatively light wall thickness of the sheath 2 of stainless steel of course results in further cost advantages.

We claim:

1. A method for producing a transverse force bolt having a steel core (1) and a sheath (2) of stainless steel, comprising the steps:

dimensionally drawing-in, substantially free of play, the steel core (1) of non-stainless steel into a tube of stainless steel which forms the sheath (2) and thereby forming a rod;

cutting the rod to a desired transverse force bolt size;

partially ejecting the core (1) from the sheath (2) and cutting off an ejected portion (5) of the core (1);

pushing the core (1) back by one-half of a length of the cut off ejected portion (5); and closing open sheath ends (6) of the sheath (2).

2. The method in accordance with claim 1, wherein the open sheath ends (6) are closed by a plastic plug (7).

3. The method in accordance with claim 1, wherein each of the open sheath ends (6) is closed by a disk (9) of stainless steel pushed into the open sheath ends (6) and welded to the sheath (2).

4. The method in accordance with claim 1, wherein exterior dimensions of the sheath (2) are calibrated during the dimensional draw-in step.

5. The method in accordance with claim 1, wherein the rod is briefly heated from an outside prior to partial ejection of the core (1) from the sheath (2).

* * * * *